US006229094B1

(12) United States Patent
Krause

(10) Patent No.: US 6,229,094 B1
(45) Date of Patent: May 8, 2001

(54) TORQUE PREVAILING CRIMPED INSULATOR FITTING

(75) Inventor: John A. Krause, Eastlake, OH (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/192,520

(22) Filed: Nov. 16, 1998

(51) Int. Cl.[7] ..... H01B 17/06
(52) U.S. Cl. ..... 174/177; 174/209
(58) Field of Search ..... 174/176, 177, 174/178, 179, 193, 209

(56) References Cited

U.S. PATENT DOCUMENTS

| | | | | |
|---|---|---|---|---|
| 4,797,121 | | 1/1989 | Hayward | 439/579 |
| 5,228,721 | | 7/1993 | Whittle et al. | 285/23 |
| 5,336,852 | * | 8/1994 | Goch et al. | 174/176 |
| 5,364,134 | | 11/1994 | Anderson | 285/38 |
| 5,364,135 | | 11/1994 | Anderson | 285/38 |
| 5,977,487 | * | 11/1999 | Kuhl | 174/176 |

* cited by examiner

*Primary Examiner*—Dean A. Reichard
*Assistant Examiner*—Adolfo Nino
(74) *Attorney, Agent, or Firm*—Jerry M. Presson; Leopold Presser

(57) ABSTRACT

An insulator having a torque-resistant or torque-prevailing crimped insulator end fitting; including a method of crimping the insulator end fitting so as to be resistant to torque tending to loosen mounting bolt connections of the insulator. A fiberglass core is located in the insulator and protrudes from the opposite ends of the insulator, and has end fittings seated thereon in close interference engagement, by mounting the insulator through intermediary of the end fittings being attached to power devices by threaded bolts extending from the devices being engaged in the tapped bolt holes. Radially inwardly directed crimping forces are applied to the cylindrical wall structure of the end fittings intermediate the locations of the bosses having the bolts tightened within the threaded bolt holes, and thereby produce a bolt-locking deformation of the bolt holes.

10 Claims, 1 Drawing Sheet

TORQUE PREVAILING CRIMPED INSULATOR FITTING

BACKGROUND OF THE INVENTION

1. Field of the Invention

The present invention relates to an insulator having a torque-resistant or torque-prevailing crimped insulator end fitting. More particularly, the invention is also directed to a method of crimping an insulator end fitting so as to be resistant to torque tending to loosen mounting bolt connections of the insulator.

The utilization of rubber-covered insulators possessing fiberglass cores, and which incorporate metal end fittings, is widely known and employed in connection with an extensive variety of both overhead and underground electrical power transmission devices. For instance, one such device employing an insulator comprises a pad mount switch gear wherein the insulator is utilized as a support mechanism for hardware which is at line potential, with such insulators being frequently in the configuration of so-called post insulators, as is known in the technology.

Ordinarily, in order to mount the insulator to the hardware, arranged at each end of the post insulator are between two or four bolts which are engage able into tapped or threaded bolt holes. Suitable lock washers are arranged on the bolts in order to eliminate any bolt rotation or loosening subsequent to the application of the appropriate necessary tightening torque to the connector bolts of the end fitting.

The prevention of any bolt loosening is imperative, inasmuch as any loose bolts can readily result in the insulator performing improperly, and could also be conceivably the cause of radio noise or static. In essence, an important problem facing the industry in connection with the foregoing resides in the prevention of any loosening of the connections of the end fittings, and resultingly, the attachment of the insulators to the devices where the insulators are employed as support mechanisms.

2. Discussion of the Prior Art

Presently, various types of end fittings for piping or similar uses are known and widely employed in industry and commerce.

Whittle, et al., U.S. Pat. No. 5,228,721 discloses a pipe fitting wherein a pipe end is adapted to be inserted into a suitable end fitting. The fitting has a tubular section insertable into the pipe end, and has a plurality of axially spaced, radially outwardly extending circumferential ribs. The pipe fitting, with the end of the pipe extending thereover, has the pipe end encompassed by an annular sleeve. A crimping ring is mounted on the sleeve and then crimped inwardly so as to cause the ribs to bite into and grippingly engage the inner circumferential wall surface of the pipe end, thereby locking all of the elements together. This is basically a standard type of crimping arrangement for various types of piping or the like, necessitating numerous components which are not particularly suitable for post insulators.

Anderson, U.S. Pat. Nos. 5,364,134 and 5,364,135 each disclose an end fitting for flexible conduits, wherein a crimping ring is adapted to be positioned about an axially a projecting portion of the end fitting so as to be insertable into the essentially cylindrical conduit. Thereafter, the crimping ring is crimped radially inwardly so as to provide a gripping and axially locked contact with the conduit and the end fitting.

Hayward, U.S. Pat. No. 4,797,121 discloses a "tee" fitting for tapping into a coaxial cable network, wherein crimping sleeves or rings are slid over an external insulation segment of the conduits and then crimped so as to produce a gripping or clamping engagement with the insulation and the fitting.

Although the foregoing publications disclose various types of crimping rings, none of these are applicable to providing the torque-resistant fastening of piping or conduits to end fittings for insulators of the type described herein, inasmuch as the various prior art crimping rings are not torque-prevailing or torque-resistant, and in effect, permit for rotational movement between the various fitting components while concurrently possessing only a limited degree of strength against the effects of axial tensile forces.

SUMMARY OF THE INVENTION

Accordingly, the present invention provides for post insulator structures which may be constituted of rubber and contain rubber-coated fiberglass cores, and possessing metallic end fittings at opposite ends of the post insulator. The essentially elongate tubular insulator may be equipped with a series of circumferential disk elements or fins forming weather sheds which are spaced along the length of the insulator, and with the metal end fittings being fastened to opposite ends of the post-shaped tubular insulator, the latter of which is adapted to receive the cylindrical fiberglass cores.

To facilitate the secure attaching of the insulator to various electrical power devices; for instance, such as pad mount switch gears or the like, wherein the insulator is basically employed as a support mechanism for hardware at line potential, the insulator is equipped with metallic end fittings at each end thereof. The fittings are each constituted of an essentially hollow cylindrical sleeve-like element having bosses spaced thereabout. The bosses are basically circular protrusions each tapped to provide bolt holes extending in parallel to the center axis of the fitting to a particular depth so as to form either blind or through-extending screwthreaded bores.

In order to provide for the fastening together of the various components comprising the post insulator, the fiberglass core located therein and which protrudes from the opposite ends of the insulator and has the end fittings seated thereon in close interference engagement, by mounting the insulator through the intermediary of the end fittings being attached to power devices by threaded bolts extending from the devices being engaged in the tapped bolt holes, and whereby radially inwardly directed crimping forces are applied to the cylindrical wall structure of the end fittings intermediate the locations of the bosses having the bolts tightened within the threaded bolt holes. The radial crimping forces intermediate the bolt hole locations produce a deformation of the bolt holes, in effect, the fitting material is crimped such that the tapped bolt holes in the bosses deviate or distort from their original round configurations in that the material is pushed radially inwardly to cause the bolt holes to assume a somewhat out-of-round or ovoid configuration. This crimping action causes the screwthreads of the tapped bolt holes to deform during crimping, creating a locking engagement with the screwthreads of the therein inserted bolts, and preventing the bolts from loosening by being rotated out of the bolt holes. This, in essence, provides the bolt locking action which eliminates the need for the provision of lock washers or other fastening elements.

Accordingly, it is an object of the present invention to provide an insulator of the post type as described herein, including end fittings for connection with power ground transmission devices, wherein connector bolts are locked into tapped bores in bosses on the end fittings of the insulator through the application of crimping forces to the end fittings.

Another object of the present invention resides in the provision of a method for securing a post insulator to hardware through the intermediary of crimping action tending to deform threaded bolt holes tapped in end fittings of the insulator, thereby locking connector bolts therein secured against loosening rotation so as to ensure appropriate latching of components upon the assembling of the insulator to power devices.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION OF A PREFERRED EMBODIMENT

Figure 1:
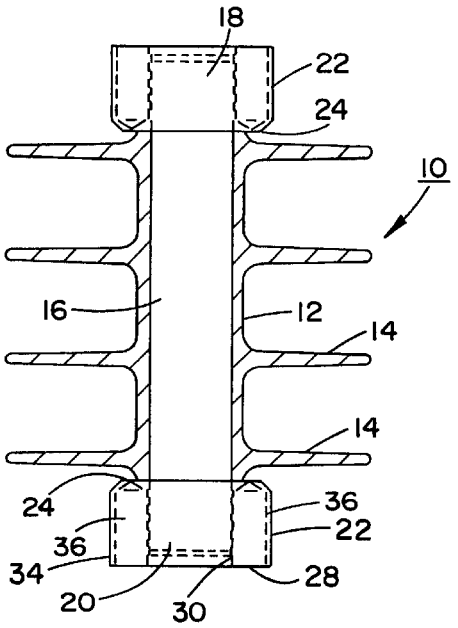
FIG. 1 illustrates a longitudinal sectional view of a post insulator having metal end fittings pursuant to the invention mounted at opposite ends thereof.
Figure 2:
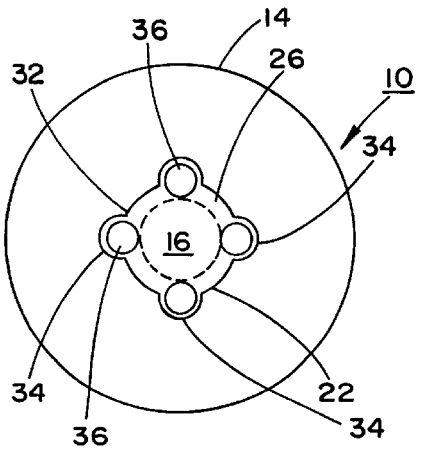
FIG. 2 illustrates an end view of the post insulator showing an end fitting prior to being crimped.

As illustrated in the drawings, with specific reference to drawings FIGS. 1 and 2, a post insulator 10 may be employed as a support mechanism for electrical hardware at line potential; for example, such as the hardware being a pad mount switch gear or the like, as is known the power industry. The insulator includes an elongate hollow tubular portion 12 which is preferably constituted of rubber, and in which the hollow tubular portion includes a plurality of axially spaced, radially extending circumferential fins 14 forming weather sheds, as is well known in the technology. Extending within the hollow tubular portion 12 of the insulator 10, and secured against rotation and axial displacement relative thereto, is a solid cylindrical rod-like core 16, consisting preferably of rubber-coated fiberglass. The opposite ends 18, 20 of the cylindrical core protrude outwardly of the respective ends of the hollow insulator tubular portion 12.

Each respective end 18, 20 of the cylindrical core 16 protruding from the hollow tubular portion 12 has a metallic fitting 22 fixedly mounted thereon, with the end surface 24 of each end fitting, as shown in FIG. 1 of the drawings, being in close surface contact with the contiguous end of the tubular portion 12 of insulator 10.

As shown in FIGS. 1 and 2 of the drawings, each metallic end fitting 22 is essentially a cylindrical element 26 having planar and parallel end surfaces 24 and 28, and provided with an axial center bore 30 which is adapted to be seated on the protruding end portion 18, or respectively 20, of the fiberglass core 16.

The outer cylindrical surface 32 of the end fitting 22 includes a plurality of circumferentially spaced bosses 34, each of these bosses being of a raised circular configuration, and extending in parallel and coaxial orientation with the axial center bore 30 of the end fitting 22 over the width thereof. Illustrated are four bosses 34 spaced 90° apart; however, each end fitting 22 may possess only two or three bosses, or a larger number than four, as may be required for specific applications.

Tapped into each boss 34 is a screwthreaded blind or through-extending bore 36, extending along the axial width of the width of the end fitting 22, with the tapped bores being arranged on a bolt circle adapted to be in alignment with bolt holes formed in flanges or connectors of devices (not shown) to which the insulator 10 is to be attached by means of threaded bolts which are to be screwed into the tapped bores 36 from outside the surface 28.

Upon the assembling of the post insulator 10 with a power device, such as a pad mount switch gear or the like or other suitable hardware of that type, a flange or connector, (not shown) of the device has bolt holes thereof positionable in alignment with the threaded or tapped bores 36 in the bosses 34 of the end fittings 22. Suitable bolts are then inserted through the bolt holes and screwed into the tapped bores 36, and torqued so as to provide a tightly clamped relationship between the end fittings and the attached hardware components or power devices.

Figure 3:
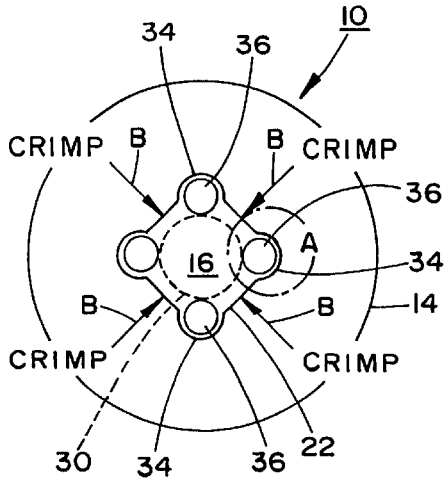
FIG. 3 illustrates an end view similar to FIG. 2 illustrating the end fitting subsequent to crimping action having been imparted thereto.
Figure 4:
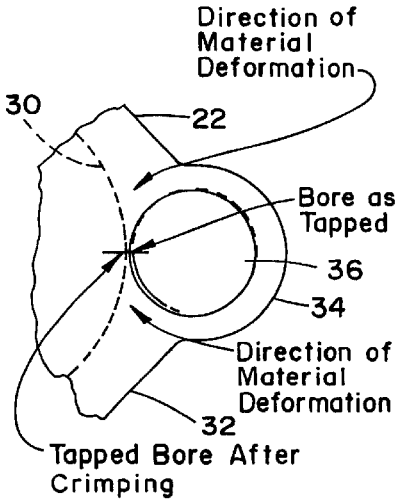
FIG. 4 illustrates an enlarged fragmentary view of the encircled portion A of the end fitting of FIG. 3.

In order to prevent the bolts from loosening and rotating out of the bores 36 during operation of the insulator and power devices, which would result in the previously mentioned operating problems, radially inwardly directed crimping forces are applied to the surfaces of the end fittings 22 intermediate each of the bosses 34 having the tapped bolt bores 36, as shown by arrows B in FIG. 3 of the drawings. The crimping forces which are applied so as to act radially inwardly between each of the bosses 34, deform the portion of the material intermediate the bosses 34, as shown in FIG. 3 of the drawings, thereby causing the material adjacent the bosses 34 to be deflected radially inwardly. This, in effect, will produce a deformation of the tapped bolt holes 36, as shown in FIG. 4, in the enlarged detail of the drawings, such that each tapped bore 36 having a bolt (not shown) positioned therein, is deformed into an out-of-round or ovoid shape, resulting in the screwthreads deforming during crimping. This deformation of the bore screwthreads jams the material thereof with the threads of the bolts and prevents the bolts from rotating and loosening by essentially creating a bolt locking mechanism. Consequently, the crimping action which is imparted to the metal end fittings 22 produces a torque-resistant or torque-prevailing locking action securing the power devices or hardware to the post insulator 10 without the need for any other external locking components, such as lock washers or crimping rings as are heretofore employed in the technology.

From the foregoing, it becomes readily apparent that the inventive construction is simple in nature and operation and may be readily employed without the need for special tooling and with a minimum number of components, so as to provide an inexpensive and highly reliable construction which is secure against the separation or loosening of the components during operation.

While there has been shown and described what is considered to be a preferred embodiment of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. An end fitting which is mounted on an end portion of an insulator core which protrudes from an insulator; said end fitting comprising:

(a) a cylindrical body having an axial center aperture for seating said end fitting on the insulator core end portion;

(b) a plurality of bosses formed on an outer circumferential surface of said cylindrical body, said bosses being uniformly spaced about said cylindrical body, each of said bosses extending across the width of said cylindrical body in parallel and coaxially with said axial center aperture;

(c) and a tapped bore for receiving a screwthreaded bolt being formed in each of said bosses for the attachment of said end fitting to selective devices, said cylindrical body being crimpable in peripheral regions intermediate said bosses so as to deform said tapped bores and torque-prevailingly engage the screwthreads of bolts located therein so as to secure such bolts against rotation and inhibit loosening between said end fitting and a device attached thereto.

2. An end fitting as claimed in claim 1, wherein each said boss has a generally cylindrical cross-sectional configuration.

3. An end fitting as claimed in claim 1, wherein said tapped bores are deformable responsive to radially inwardly directed crimping forces being applied to said cylindrical body intermediate adjacent of said bosses.

4. An end fitting as claimed in claim 1, wherein said end fitting is constituted of a metallic material.

5. An end fitting as claimed in claim 1, wherein four of said bosses are equidistantly spaced about the circumference of said cylindrical body.

6. A method of mounting an end fitting on an end portion of an insulator core which protrudes from an insulator; said method comprising:

(a) providing a cylindrical body having an axial center aperture for seating said end fitting on the insulator core end portion;

(b) forming a plurality of bosses on an outer circumferential surface of said cylindrical body, said bosses being uniformly spaced about said cylindrical body, each of said bosses extending across the width of said cylindrical body in parallel and coaxially with said axial center aperture;

(c) and forming a tapped bore for receiving a screwthreaded bolt in each of said bosses for the attachment of said end fitting to selective devices, and crimping said cylindrical body in peripheral regions intermediate said bosses so as to deform said tapped bores and torque-prevailingly engage any screwthreaded bolts located therein so as to secure such bolts against rotation and inhibit loosening between said end fitting and a device attached thereto.

7. A method as claimed in claim 6, wherein each said boss has a generally cylindrical cross-sectional configuration.

8. A method as claimed in claim 6, wherein said tapped bores are deformable responsive to radially inwardly directed crimping forces being applied to said cylindrical body intermediate adjacent of said bosses.

9. A method as claimed in claim 6, wherein said end fitting is constituted of a metallic material.

10. A method as claimed in claim 6, wherein four of said bosses are equidistantly spaced about the circumference of said cylindrical body.

* * * * *